US006767357B2

(12) United States Patent
Uehara et al.

(10) Patent No.: US 6,767,357 B2
(45) Date of Patent: Jul. 27, 2004

(54) TEETHING RING AND BEARING PLATE

(75) Inventors: Hiroyuki Uehara, Tokyo (JP); Aki Ishimaru, Tokyo (JP); Masayuki Nakahara, Tokyo (JP)

(73) Assignee: Pigeon Corporation, Tokyo (JP)

( * ) Notice: Subject to any disclaimer, the term of this patent is extended or adjusted under 35 U.S.C. 154(b) by 0 days.

(21) Appl. No.: 09/926,672

(22) PCT Filed: Mar. 29, 2001

(86) PCT No.: PCT/JP01/02647

§ 371 (c)(1),
(2), (4) Date: Feb. 19, 2002

(87) PCT Pub. No.: WO01/74293

PCT Pub. Date: Oct. 11, 2001

(65) Prior Publication Data

US 2003/0163162 A1 Aug. 28, 2003

(30) Foreign Application Priority Data

Mar. 31, 2000 (JP) ..... 2000-101252

(51) Int. Cl.[7] ..... A61J 17/00
(52) U.S. Cl. ..... 606/235; 606/236
(58) Field of Search ..... 606/234, 235, 606/236

(56) References Cited

U.S. PATENT DOCUMENTS 4,193,407 A * 3/1980 Edmark ..... 128/360
4,715,379 A * 12/1987 McCormick ..... 128/360
4,796,628 A * 1/1989 Anderson ..... 128/360
5,156,617 A * 10/1992 Reid ..... 606/234
5,211,656 A * 5/1993 Maddocks et al. ..... 606/236
5,275,619 A * 1/1994 Engebretson et al. ..... 606/236
5,334,218 A * 8/1994 Johnson ..... 606/235
5,578,058 A * 11/1996 Chen ..... 606/236
5,601,605 A * 2/1997 Crowe et al. ..... 606/236
5,653,731 A * 8/1997 Rohrig ..... 606/234
5,759,195 A * 6/1998 Fields et al. ..... 606/236

FOREIGN PATENT DOCUMENTS

| | | | |
|---|---|---|---|
| GB | 2240723 A | * | 8/1991 |
| JP | 40-29229 | | 10/1965 |
| JP | 50-60355 | | 5/1975 |
| JP | 53-23748 | | 3/1978 |
| JP | 58-133255 | | 8/1993 |
| JP | 2000-135270 | | 5/2000 |
| JP | 2000-279487 | | 10/2000 |

* cited by examiner

*Primary Examiner*—Michael J. Milano
*Assistant Examiner*—Charles H. Sam
(74) *Attorney, Agent, or Firm*—Westerman, Hattori, Daniels & Adrian, LLP

(57) ABSTRACT

This invention relates to a pacifier that may properly interest an infant of eight months old or older to make a preferable stimulation, for leading the infant to the next developmental stage of ingesting activity, or that can be used in a way for adapting to more advanced ingesting activity. A pacifier is provided with a nipple (11) and a shield plate (12) disposed at the base portion (13) of the nipple which has a predetermined width. The nipple is provided with a tip portion (15) having a width and a thickness, the width being larger than the thickness, to be formed into a flat shape, and an upper curved surface (19) formed at the upper surface of the tip portion so as to be convex at a central portion thereof.

8 Claims, 6 Drawing Sheets

TEETHING RING AND BEARING PLATE

TECHNICAL FIELD

The present invention relates to a pacifier which is intended to be used by an infant preferably of about eight months old or older. The present invention also relates to a shield plate for preparing a pacifier and so on.

TECHNICAL BACKGROUND

It is well known that there is a pacifier as toy used by an infant at nursing and weaned ages or older.

Such a pacifier is generally intended to be held by an infant in his/her mouth to make an oral stimulation so as to interest him/her. It is well known that an infant between birth and four months of age is entirely nursed by his/her mother with her breast as a source of nutrition. Therefore, one type of conventional pacifier is known which is provided with a nipple shaped like an artificial nipple.

For example, FIG. 9 shows a partial cross-sectional view of a conventional pacifier. As shown in FIG. 9, the pacifier 1 comprises a nipple 2 having a shape similar to that of an artificial nipple, and a flange-shaped shield plate 3 supporting the nipple 2. The pacifier 1 is also provided with a handle 4 extending from the shield plate 3 in the opposite direction of the nipple 2.

In such a conventional pacifier 1, the nipple 2 is shaped like an artificial one. Therefore, the pacifier 1 may be held by an infant between birth and about four months of age and stimulate to suckle so as to interest him/her.

Due to the shape of the nipple 2, the pacifier 1, as shown in FIG. 9, generally may interest an infant who is entirely nursed. However, it is not appropriately formed for an infant who is more developed to discourage him/her from suckling and to start eating baby or general foods.

Namely, especially at the age of about eight months old or older, an infant starts to practice ingesting baby or general foods, for which it is required to move his/her mouth in quite a different way than how he/she used it to suckle breast-milk. Therefore, the conventional pacifier is inappropriate for the infant, which is designed only taking suckling into consideration and which is provided with a nipple shaped like a mother's one. Therefore, even if it is held by such an infant, it stimulates him/her inappropriately for his/her growth and no longer properly interest him/her.

There are several objects to be solved with respect to the conventional pacifier, which will be described as follows.

1. In case of ingesting not breast milk and formula but foods, it is necessary for an infant to take foods into his/her mouth and then to close his/her mouth. The conventional pacifier however has a nipple similar to a mother's one, so that when the pacifier is held in the mouth, it enters his/her concaving roof of the mouth, which results in stimulating to move peristaltically for suckling movement. Therefore, the conventional pacifier interrupts to train an infant who starts to be weaned from suckling and to close his/her mouth, though it is required to outgrow suckling and then to start the next developmental stage of ingestion.

2. Also, at such an age, an infant begins trying to eat baby food and to speak so that he/she must change the form of his/her lips, which results in increasing the number of mouth breaths. Since the infant takes foods and then closes his/her mouth, he/she cannot breathe through his/her mouth at that time. Therefore, he/she must breathe through his/her nose when eating food. The structure of the conventional pacifier, however, does not take it into consideration to train to do so.

3. Further, if an infant at such an age gets into the habit to breathe through his/her mouth as mentioned above, he/she continues to breathe through mouth even after grown up into an adult, which results in directly affecting his/her throat and sometimes causes a serious problem such as decreasing his/her immunity. Therefore, it is important for such an infant to acquire the habit of breathing through his/her nose.

Therefore, there are several objects to be solved as mentioned above, and the present invention provides a pacifier or a shield plate for preparing a pacifier and so on, which properly interest an infant of about eight months old or older and stimulates him/her adequately in a way suitable for his/her the growth. The pacifier or the shield plate according to the present invention also can be used for directing him/her to the next stage of development regarding ingestion, and be suitably used in the stage.

SUMMARY OF THE INVENTION

According to the present invention, the objects as described above may be overcome by a pacifier having a nipple and an extending shield plate attached on a base portion of the nipple, the nipple comprising, a tip portion having a width and a thickness, the width being larger than the thickness, to be formed into a flat shape extending in a horizontal plane, and an upper curved surface formed on an upper surface of the tip portion, the upper curved surface being designed to have a convex shape at a central portion thereof.

An infant generally has a concaving roof of the mouth in a form of hole, into which a round body such as the top of mother's nipple may fit. According to the feature as mentioned above, the pacifier according to the present invention has a nipple having a tip portion formed into a flat shape extending in a horizontal direction, so as not to be designed to fit into the concaving roof of the infant's mouth In other words, the tip portion of the nipple extends in a horizontal direction so as not to fit into the concaving roof of the infant's mouth. Also, the upper curved surface formed on an upper surface of the tip portion, having a convex shape at a central portion thereof, is formed to fit with the hard palate located in front of the concaving roof of the mouth of an infant (in other words, which is located on the upper lip side), so that the nipple may be positioned on the hard palate in the mouth when the pacifier is held by the infant.

Therefore, the pacifier is designed not to encourage suckling due to make such a stimulation when the nipple enters the concaving roof of the month of an infant. The nipple is also designed to be easily held inside the mouth.

When the nipple is held by the mouth, it directs not to make a stimulation to suckle but to make a stimulation corresponding to the next intake style, which is to close the lips when he/she takes foods in the mouth.

Also, according to another feature of the present invention, it is characterized in that the width of the tip portion of the nipple is designed to be larger than a concaving roof of the mouth of a user infant.

Under the feature as mentioned above, since the width of the tip portion of the nipple is designed to be larger than the concaving roof of the mouth of the user infant, the pacifier according to the present invention further prevents the tip portion of the nipple from entering the concaving roof of the mouth.

Also, according to another feature of the present invention, it is characterized in that the tip portion of the nipple has a lower curved surface having a convex shape formed at a central portion thereof.

Under the feature as mentioned above, an infant is trained to learn a manner necessary for taking baby or general foods to outgrow suckling and then to start the next stage of ingestion. In the case of such ingestion, foods are gathered at the center of the tongue and then swallowed, for which the tongue has to be transformed for gathering the foods into the center thereof. The lower curved surface is designed to train him/her to learn how to sink the center of the tongue for gathering foods.

Also, according to another feature of the present invention, it is characterized in that the lower curved surface is designed to be more flexible than the upper curved surface.

Under the feature as mentioned above, since the lower curved surface of the tip portion is designed to be more flexible, the pacifier may train his/her tongue to learn a manner for ingesting foods as described hereinafter. In order that the lower curved surface is formed to transform more flexibly, the lower curved surface may be made of it material having a thickness thinner than that of the upper curved surface in the case of the nipple being hollow. Alternatively, the lower curved surface may be made of a material more flexible than that of the upper curved surface.

According to another feature of the present invention, the nipple is formed to have a vertical length shorter than a horizontal length near the base portion thereof so that the nipple is formed to have a constricted part whose cross section is flat.

Under the feature as mentioned above, the constricted part trains an infant to close the lips, and is designed to be held between an upper and a lower alveolars. The constricted part has a vertical length shorter than a horizontal length to be formed to have a flat cross-section so that the constricted part may be hooked easily in a small space formed between the upper and the lower alveolars. Therefore, the pacifier may be held by an infant in his/her mouth without dropping.

According to another feature of the present invention, the constricted part occupies an area having a length, the length being designed to be longer on the lower side of the nipple than on the upper side thereof.

Under the feature as mentioned above, since an infant has a horizontal gap generated between an upper and a lower alveolars when closing his/her lips, the length of the area where the constricted part occupies is designed to be longer on the lower side of the nipple than on the upper side thereof. Generally, it is natural that when closing the lips, the lower alveolar meets with the upper alveolar with the former located inside the latter. Therefore, the lower side of the constricted part for contacting the lower alveolar is designed to be located farther from the shield plate, and, on the other hand, the upper side of the constricted part for contacting the upper alveolar is designed to be located closer to the shield plate. In other words, the lengths forming the constricted part are varied between the upper and the lower sides thereof.

According to another feature of the present invention, it is characterized in that an area where the base portion of the nipple is connected to the shield plate is made of a member softer than that of the shield plate.

In the feature as mentioned above, the area, where each of the tops of the lips contacts when the nipple is held by an infant in his/her mouth, corresponds to "an area where the base portion of the nipple is connected to the shield plate." The area is made of a member softer than that of the shield plate so that an infant feels such as he/she touches his/her lips to a mother's breast.

According to another feature of the present invention, it is characterized in that the width of the constricted part is designed to be smaller than that of the tip portion Under the feature as mentioned above, the constricted part has a width smaller than that of the tip portion, so that the tip portion has a portion constricted in the horizontal direction. Therefore, the horizontally constricted portion hooks in the mouth, so that the nipple is prevented from falling out and dropping unexpectedly.

According to another feature of the present invention, it is characterized in that the shield plate is made of a plate member surrounding the base portion of the nipple, and wherein the shield plate has a face surface for facing the user having a closely contacting portion, the closely contacting portion being formed to be concave at least at both sides of the face surface.

Under the feature as mentioned above, the face surface of the shield plate is formed to be concave at least at the right and the left sides thereof for facing a user so as to correspond to each of the curved surfaces of the cheeks of an infant, which results in improving a feeling when the infant touches the shield plate.

Therefore, when an infant sucks the nipple, the shield plate is fitted certainly to his/her lips so that the nipple shaped as mentioned above may function preferably according to the present invention.

According to another feature of the present invention, it is characterized in that the face surface of the shield plate has a dull area curved outwardly at a periphery at least at the right and the left sides of the face surface.

Under the feature as mentioned above, since the face surface of the shield plate has a dull area at a periphery at least at right and the left sides of the face surface, so that the pacifier according to the present invention prevents the periphery of the shield plate from pressing strongly at an adjacency of the user's lips.

According to another feature of the present invention, it is characterized in that an area where the face surface of the shield plate contacts a chin of the user is curved in an opposite direction to the closely contacting portion.

Under the feature as mentioned above, since an area where the face surface of the shield plate contacts a chin of the user is curved in the opposite direction of the closely contacting portion, the area does not interfere with the user's chin, which protrudes a little bit forward.

According to another feature of the present invention, the face surface of the shield plate extends to an upper periphery thereof without forming a dull portion so that the upper periphery comprises a curved surface curved in the same direction to the face surface.

Further, the present invention relates not only to a pacifier but also to a shield plate for preferably attaching to the base portion of the nipple of a pacifier. The shield plate according to the present invention may be attached not only to a pacifier but also to any nipple, teether having a similar form and so on, held by an infant in his/her mouth.

The structure of the shield plate is designed to be attached to a base portion of a nipple for a pacifier and so on, the shield plate comprising a plate member surrounding the base portion, and a face surface for facing a user having a closely contacting portion formed to be concave at least at the right and the left sides of the face surface.

According to another feature of the present invention, it is characterized in that the face is designed to be curved outwardly at least at a periphery of the right and the left sides thereof so as to form a dull portion.

According to another feature of the present invention, it is characterized in that an area where the face surface of the shield plate contacts a chin of the user is curved in the opposite direction of the closely contacting portion.

According to another feature of the present invention, it is characterized in that the face surface of the shield plate extends to an upper periphery thereof without forming a dull portion so that the upper periphery comprises a curved surface curved in the same direction to the face surface.

PREFERRED EMBODIMENT OF THE PRESENT INVENTION

The present invention is described in detail as follows based on an embodiment with reference to appended drawings.

Since the following descriptions are based on the best mode known by the inventors of the present invention, they are technically limited in detail. However, unless it is described explicitly to limit the scope of the present invention in the following descriptions, the present invention should not be limited or restricted by the following descriptions.

Figure 1:
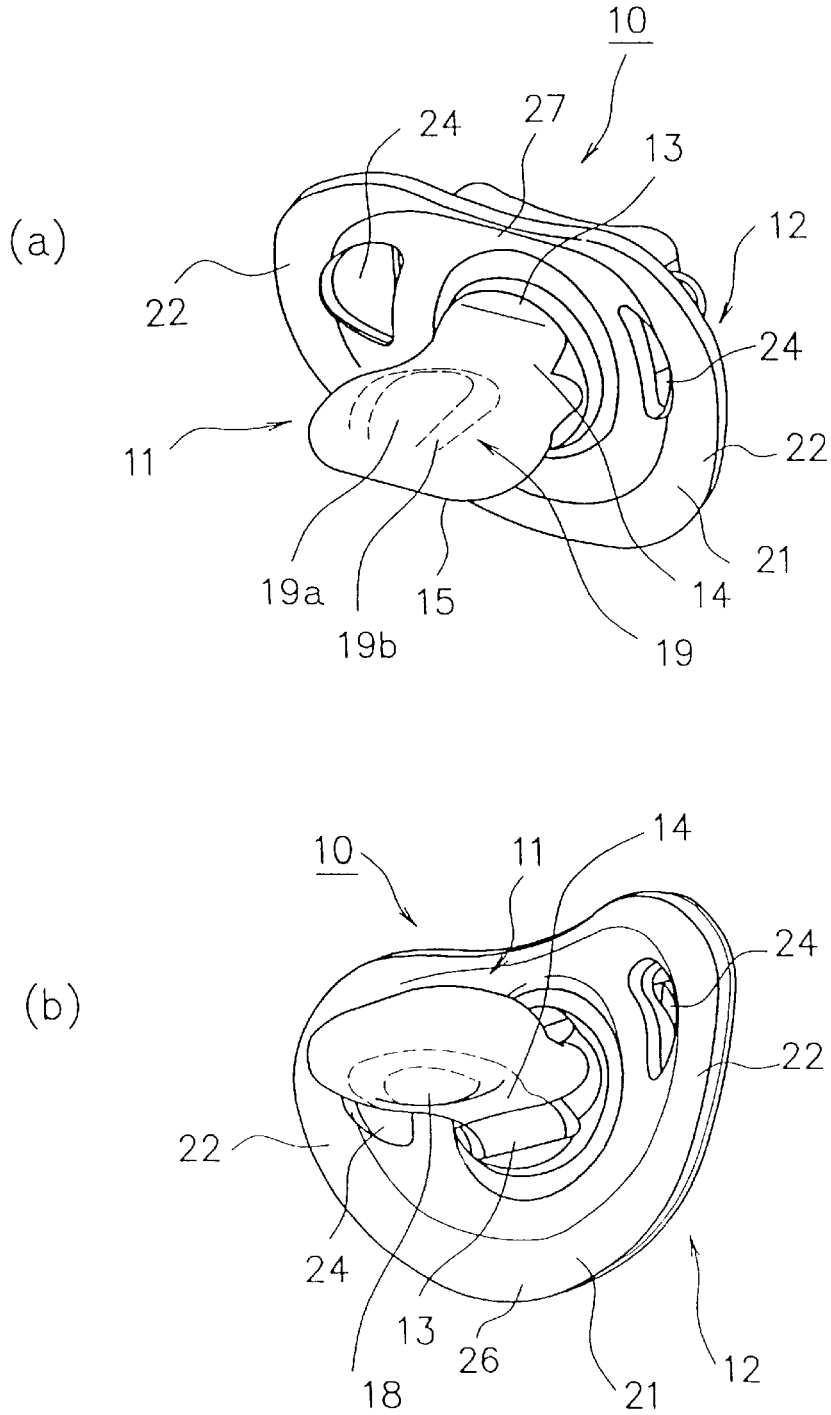
FIG. 1 shows an embodiment of the pacifier according to the present invention, and (a) is a perspective view from a vantage point in front of and above the pacifier, and (b) is a perspective view from a vantage point in front of and below the pacifier.
Figure 2:
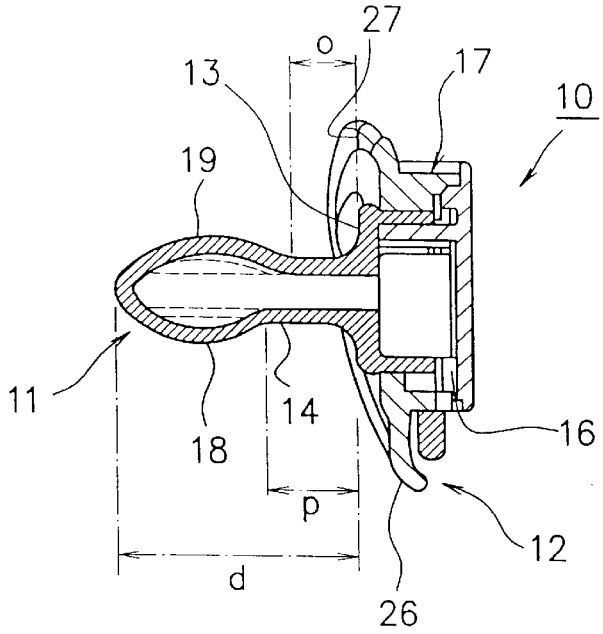
FIG. 2 shows a vertically cross-sectional view of the pacifier shown in FIG. 1
Figure 3:
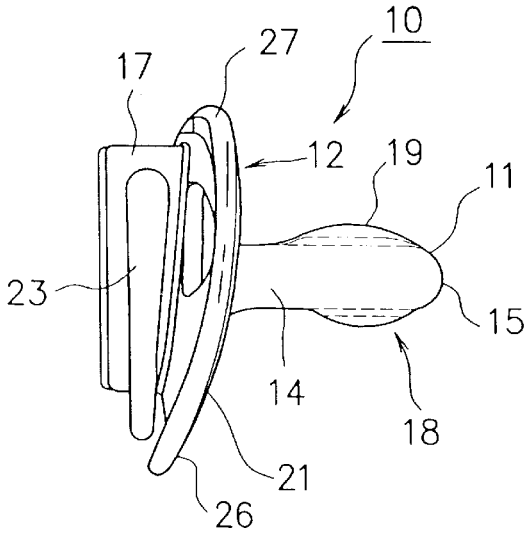
FIG. 3 shows a side view of the pacifier shown in FIG. 1.
Figure 4:
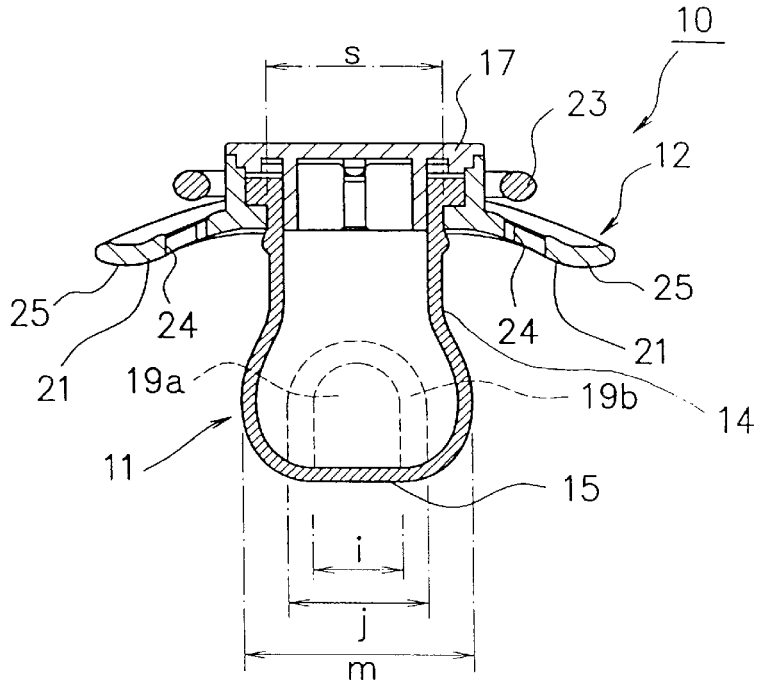
FIG. 4 shows a horizontally cross-sectional view of the pacifier shown in FIG. 1
Figure 5:
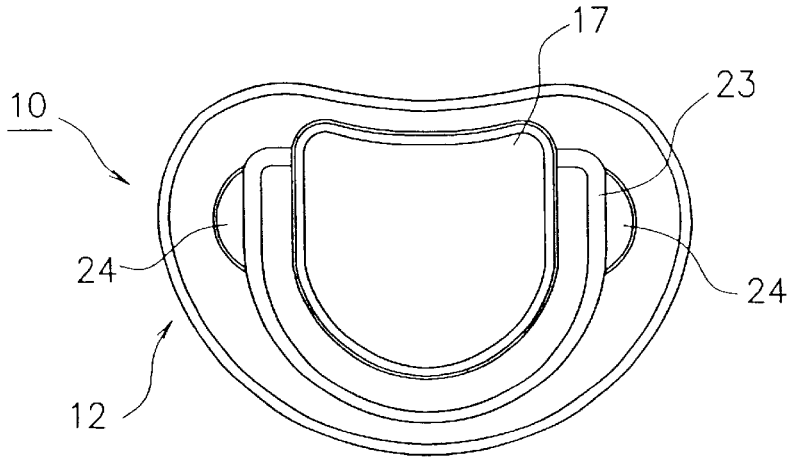
FIG. 5 shows a back view of the pacifier shown in FIG. 1.

FIG. 1 shows an embodiment of a pacifier, and FIG. 1(*a*) shows a view from a vantage point in front of and above the pacifier and FIG. 1(*b*) shows a view from a vantage point in front of and below the pacifier. Also, FIG. 2 shows a cross-sectional side view, and FIG. 3 shows a side view, and FIG. 4 shows a cross-sectional view in a horizontal direction. The pacifier of the present embodiment is described with reference to these drawings As shown in FIG. 1, the pacifier 10 has a nipple 11 and an extending shield plate 12 disposed at a base portion of the nipple.

The nipple 11 is provided with a tip portion 15 and a base portion 13 for supporting the nipple 11 on the shield plate 12. Also, the nipple has between the tip portion 15 and the base portion 13 a horizontal and a vertical lengths, the vertical length being shorter than the horizontal length, so as to form a constricted part 14 whose cross-section is flat-shaped.

The nipple 11 is designed to withstand a fragility in heat sterilization by submersion in boiled water and so on, as well as to make a feeling like a mother's nipple. Since it is required that the embodiment of the pacifier is entirely transformed in the mouth of an infant, the pacifier is made of a very flexible material such as silicon rubber. For example, using a tool having a body with a width of 10 mm and a head point with a radius of 5 mm, the head point of the tool presses the tip portion 15 of the pacifier at a speed of 100 mm per minute to compress its maximum outer radius of the tip portion 15 into 40 percent thereof. At that moment, the pacifier is designed to have a hardness that a repulsion between 1.0 and 2.5N, preferably of 1.5N is obtained.

Also, the shield plate 12 with the nipple 11 is made of a material to withstand a fragility against the above mentioned sterilization, as well as to have a predetermined rigidity, such as polypropylene, polycarbonate and so on.

As shown in FIG. 2, the nipple 11 is preferably designed to have a length (d) from the shield plate 12 to the tip portion, the length (d) being approximately 15 to 26 mm, and, in particular, this embodiment has the length (d) of 25.5 mm. Thus, the tip portion 15 is designed not to reach the concaving roof of the mouth, which remains in a pronounced concave shape for an infant at such an age (that is approximately from eight months old to three years old) as described hereinafter. When the length (d) from the shield plate 12 to the tip portion 15 is longer than about 26 mm, it may be possible for the tip portion 15 to enter the concaving roof of the mouth. On the other hand, when the length (d) is shorter than 15 mm, it will be too short for the nipple to extend from the tops of the lips to the alveolars so as to be insufficiently held at the constricted part 14 as described hereinafter between the upper and the lower alveolars.

Namely, an infant has a hole-shaped or concaving roof of the mouth formed on the upper jaw, into which the top of his/her mother's nipple is put for suckling. However, as the infant grows, the concaving roof of his/her mouth is gradually shallowed to disappear, which corresponds to his/her changing form of ingestion from suckling to the next stage. The pacifier 10 is designed to be appropriate for these infants.

Therefore, the tip portion 15 of the nipple 11 has a flat end extending horizontally as shown in FIG. 2, and the tip portion 15 has a width (m) formed to be broad as shown in FIG. 4, the width (m) being designed between approximately 20 to 30 mm.

In particular, if the width (m) of the tip portion 15 of the nipple 11 is less than 20 mm, the nipple may enter the concaving roof of the mouth to stimulate to suckle. On the other hand, if the width is more than 30 mm, it may interfere with the alveolars in a vicinity of the molar tooth as described below. This embodiment is designed to have a width (m) being 23 mm.

Also, the nipple 11 is designed to be hollow as shown in FIG. 2 and FIG. 4 and to communicate with the exterior through a penetrating hole 16 formed near the base portion of the shield plate 12.

Therefore, the nipple 11 contacts an inside surface of the mouth with the hardness as mentioned above, and, conveniently, infant's saliva or washing water may be removed easily.

The nipple 11 provided with the tip portion 15 is formed into a flatshape having a vertical length shorter than a horizontal length.

In addition to being formed into a flatshape, the nipple has an upper curved surface 19 formed at an upper surface of the tip portion 15. Thus, the tip portion 15 has a round-shape which is slightly pressed or flattened vertically, so that the upper curved surface 19 is formed to have a convex shape at a central portion thereof.

The base portion near the nipple 19 is designed to correspond to a curved surface of the upper jaw in the mouth of an infant who is using this pacifier 10. In particular, the upper curved surface 19 is provided with a first curved surface 19*a* at the center thereof, and a second curved surface 19*b* surrounding the first curved surface 19*a*. As shown in FIG. 4, the second curved surface 19*b* preferably has a width (j) of 13 to 17 mm. The first curved surface 19*a* is inside the second curved surface 19*b*, and has a width (m) of 11 to 13 mm. Also, the upper curved surface 19 is of a curved surface having a radius of curvature of 9 to 22 mm so that the upper curved surface 19 has a shape corresponding to the inside surface of the upper jaw of an infant.

Also, the tip portion 15 has a lower surface having a lower curved surface 18. The lower curved surface 18 is formed at the center of the lower surface of the tip portion 15, and preferably has a width of about 7.5 mm so as to have a curved surface with a radius of curvature of about 8 mm. Therefore, the lower surface of the tip portion 15 is formed as a round projection.

The lower curved surface 18 significantly serves to train an infant at such an age to move his/her tongue for ingesting.

In particular, the lower curved surface 18 of the tip portion 15 is designed to be nose flexible more than the upper curved surface 19. For example, the nipple 11 is formed to be hollow in this embodiment, and, as shown in FIG. 2, the lower curved surface 18 is made of a material having a thickness thinner than that of the upper curved surface 19, so as to flex more.

Therefore, the present invention trains an infant to move his/her tongue in a way necessary for ingestion as described hereinafter. In order to obtain such structure that the lower curved surface flexs more than the upper curved surface, the lower curved surface 18 may be made of a material softer or more flexible than that of the upper curved surface 19.

Also, between the tip portion 15 and the base portion 13, the nipple has a thickness and a width, the thickness having a length less than that of the width, so as to have a flat cross-section to thereby form a constricted part 14.

As described hereinafter, the constricted part 14 serves to be held by an infant with the nipple 11 of the pacifier 10 put into his/her mouth so as to be held between the upper and the lower alveolars. Therefore, the pacifier 10 is designed so as not to drop from the mouth, and to train an infant to close his/her mouth as described hereinafter.

Accordingly, the constricted part 14 has a thickness approximately between 3 to 7 mm. When the thickness of the constricted part 14 is less than about 3 mm, it is too thin to be held between the upper and the lower alveolars. Also, at this size, if the nipple 11 is hollow, it is difficult to be produced. On the other hand, when the thickness of the constricted part 14 is more than 7 mm, the tip portion is not as flat, which inhibits proper functioning, and thereby causes a possible "open bite" that the upper alveolar is not coupled with the lower alveolar when closing the mouth. With all this taken into consideration, the constricted part 14 of this embodiment is designed to have a thickness of 6.7 mm, approximately.

Also, as shown in FIG. 2, the constricted part 14 occupies an area having a length (o) on the lower side of the nipple and a length (p) on the upper side of thereof, the length (p) on the lower side thereof being designed to be greater than the length (o) on the upper side thereof.

The reason why the constricted part has a length (p) on the lower side thereof greater than the length (o) on the upper side thereof is as follows: An infant closes his/her lips to position the upper and the lower alveolars with a little gap generated therebetween in the horizontal direction, to which the present invention corresponds. In other words, when closing his/her lips, it is natural that the lower alveolar is coupled with the upper alveolar with the former being positioned inside the latter. Therefore, the lower side of the constricted part to be contacted by the lower alveolar is located further from the shield plate, and the upper side of the constricted part to be contacted by the upper alveolar is located closer to the shield plate. Therefore, the length (o) on the upper side of the constricted part is formed differently from the length (p) on the lower side thereof.

The constricted part 14 preferably has the length (o) on the upper side thereof of 0.7 to 1.5 mm, and, in particular, of 0.9 mm in this embodiment. On the other hand, the constricted part 14 preferably has the length (p) on the lower side thereof of 1.0 to 2.0 mm, and, in particular, of 1.2 mm in this embodiment.

Also, as shown in FIG. 4, the constricted part 14 has a width (s) less than a width (m) of the tip portion 15.

Therefore, the tip portion 15 is constricted in a horizontal direction, so that the horizontally constricted part hooks inside the mouth to thereby prevent the nipple from slipping from the mouth causing it to carelessly drop In particular, the constricted part 14 preferably has a width (s) not less than 10 mm and less than 20 mm, approximately. When the constricted part has the width (s) less than 10 mm, the area is insufficient to be held, where the lips contact to be held by an infant in his/her mouth. On the other hand, when the constricted part has the width (s) more than 20 mm, the nipple 11 is held by an infant in his/her mouth to cause the corner of the lips to expand, which results in preventing the lips from closing naturally.

The nipple 11 is provided with a shield plate 12 at a base portion 13 thereof. In particular, the base portion 13 has a generally expanding radius as shown in FIG. 2 to be attached to the shield plate 12, which portion is made of a flexible material similar to that of the nipple 11. Accordingly, the portion where an infant's lips contact when the nipple 11 is held by an infant in his/her mouth has a soft feeling, as described hereinafter.

The shield plate 12 has a box-shaped body 17 for supporting the base portion 13 of the nipple 11, and an extending surface portion 21 formed on the body 17. The surface portion 21 and the body 17 are formed integrally. The body 17 is provided with a ring-shaped hook 23 at the back side of the surface portion 21.

The surface portion 21, as shown in FIG. 1, extends into a flange-shape surrounding the base portion 13 of the nipple 11, and, for example, it is extends into a heart-shape at shown in the figure. The surface portion 21 serves to position the base portion 13 of the nipple 11 near the tops of the lips when the nipple 11 is held by an infant in his/her mouth.

The surface portion 21 of the shield plate 12 has an area extending into a horizontal direction so as to correspond to both sides of the cheeks of the infant user. Further, the surface portion 21 has closely contacting portions 22,22 formed to be concave at least at the right and the left sides of the face surface which correspond to the surface portion 21 for facing the user. In other words, the closely contacting portions 22,22 are formed to be concave to correspond to curved surfaces near both cheeks of the user's face.

Therefore, an infant sucks the nipple 11 so that each of the closely contacting portions 22,22 of the shield plate 12 contacts a vicinity of each of the cheeks of the infant to thereby take a predetermined position. In particular, not all of the closely contacting portions 22,22 needs to contact both cheeks of the infant. According to a research relating to the curvatures near the cheeks of infants between birth and about one year of age, the surface portion has a curved surface having a radius of about 40 mm.

Further, the surface portion 21 is provided with penetrated holes 24,24 formed at each of the closely contacting portions 22,22, to prevent the surface portion 21 from happening to close the mouth of an infant and causing suffocation.

Also, the shield plate has a dull area 25 curved outwardly at a periphery of each of the closely contacting portions 22,22 (which is an area outside each of the closely contacting portions), that is located at the right and the left sides of the surface portion 21. The dull area 25 is curved in the opposite direction to that of each of the closely contacting portions 11,22 curved. While each of the closely contacting portions 22,22 is formed to be concave toward the user, the dull area 25 is slightly convex toward the user, so that even if each of the closely contacting portions 22,22 strongly contacts the face of an infant, each of the peripheries thereof is designed not to press each of the cheeks deeply. Accordingly, even if the surface portion 21, in particular each of the closely contacting portions 22,22, strongly contacts the cheeks of a user infant, the present pacifier is designed to prevent the edge of the periphery from pressing the cheeks deeply so as not to leave a pressed track on his/her skin.

According to the present invention, the dull area 25 is defined to have a curved surface quite different from that of the other edge of the surface portion 21 of the shield plate 12. Namely, while the other edge of the surface portion 21 is also made of a curved surface, the dull area 25 is made of a curved surface having a radius of curvature larger than that of the other edge. For example, the other edge is made of a curved surface having a radius of curvature of about 0.9 mm, and, on the other hand, the dull area 25 is made of a curved surface having a radius of curvature of about 7 mm in this embodiment.

Also, although all of each of the closely contacting portions 22,22 do not necessarily contact both cheeks of the infant, the boundary between each of the closely contacting portions 22,22 and each of the dull areas 25,25 should contact each of the cheeks so as to reduce pressing. The boundary as mentioned above is an area where one cursed surface changes its direction into another.

Also, the surface portion 21 has a lower area 26 below the nipple 11 as shown in FIG. 1. The lower area 26 is curved in the opposite direction of each of the closely contacting portions 22,22 as shown in FIG. 2. The lower area is formed to take it into consideration that an infant has a lower jaw slightly projected forward so as to avoid interfering with the projection of the lower jaw. Therefore, the lower area 26 in the surface portion 21 is designed to adequately contact an adjacency of the lower jaw of an infant.

In particular, each of the closely contacting portions 22,22 has a curved surface with a radius of curvature of about 160 mm and to be concave toward the user face. On the other hand, the lower area 26 has a curved surface in the opposite direction of each of the closely contacting portions and having a radius of curvature of about 7 mm. It is analogous to the case of the dull area 25 that the lower area 26 has a curved edge different from that of the face surface 21 of the shield plate 12.

Also, the surface portion 21 has an upper area 27 above the nipple 11 curved in a same direction as each of the closely contacting portions 22,22. The upper area 27 has a radius of curvature less than each of the closely contacting portions 22,22, as shown in FIG. 2. For example, the upper area has a radius of curvature of 50 mm, and the closely contacting portion has a radius of curvature of 16 mm. Accordingly, the upper area 27 for facing the user is formed to have a concave shape similar to that of each of the closely contacting portions 22,22, and has a smaller radius of curvature than that of each of the closely contacting portions 22,22.

Therefore, the upper area is fitted to the curved shape of the upper lip of an infant between birth and about one year of age. In particular, the upper area appropriately contacts the upper lip of the infant when he/she closes his/her mouth.

The embodiment according to the present invention is formed as described above, and now the embodiment is described according to the condition of its use to explain its function.

First of all, an infant has a mouth whose structure is as follows.

Figure 6:
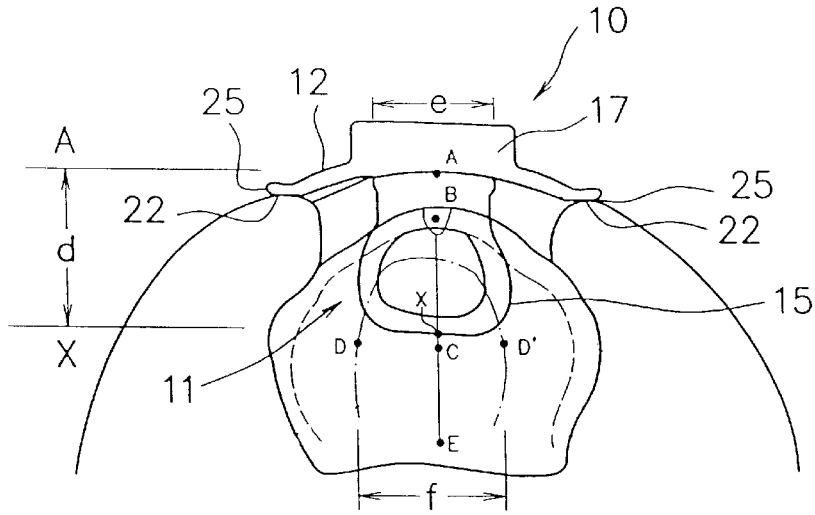
FIG. 6 shows a view of the pacifier shown in FIG. 1 which is held by an infant in his/her mouth with his/her upper jaw cross-sectioned horizontally.

FIG. 6 shows a horizontally cross-sectional view from a vantage point above the upper jaw of an infant of eight months old to three years old with the embodiment of the pacifier 10 held in his/her mouth. The infant has a concaving roof of the mouth at an adjacency of a boundary between the hard and soft palates on the upper jaw, which serves as an important part for the infant to suckle. However, as the infant grows up, the concaving roof of the mouth becomes gradually more shallow to eventually disappear.

The deepest point of the concaving roof of the mouth is pointed out by the symbol (C). In these figures, the tip of the lip of an infant is pointed out by the symbol (A), and the top of the alveolar is pointed out by symbol (B). The symbol (X) points out the tip of the nipple 11 when the pacifier is properly held by the infant to be positioned.

According to a research by the inventors of the present invention, infants between eight months of age to three years of age have average sizes of each of the parts as follows.

Namely, the lip has a thickness (A–B) of approximately 5 to 12 mm. The concaving roof of the mouth has a distance (B–C) between the top of the alveolar and the deepest point of the concaving roof of the mouth of approximately 19 to 20 mm. The concaving roof of the mouth has an outside diameter (D–D') thereof of approximately 18 to 21 mm.

Figure 7:
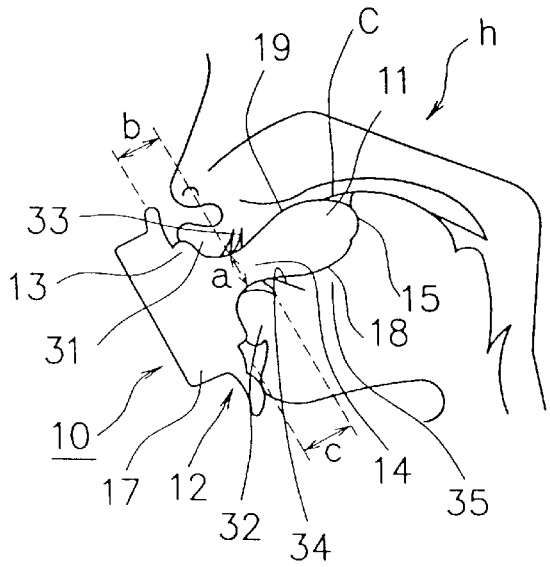
FIG. 7 shows a cross-sectional view of a pacifier held by a user infant in his/her mouth.

FIG. 7 shows a cross-sectional view in a condition where an infant (h) holds the pacifier 10 with the nipple 11 in his/her mouth.

In the figure, the infant (h) has an upper lip 31, a lower lip 32, an upper alveolar 33 and a lower alveolar 34 shown therein.

In the view shown in FIG. 7, the upper curved surface 19 of the nipple 11 contacts closely the upper palate in the mouth. In the position, the nipple 11 prevents the tip portion 15 from entering the concaving roof of the mouth for two reasons as described hereinafter, as shown in FIG. 6.

Namely, the tip portion 15 has a width (m) larger than a width (D–D') of the concaving roof of the mouth, which does not enter the concaving roof of the mouth Also, as described before, the pacifier has a length (d) between the shield plate 12 and the tip potion 15, the length (d) being designed not to reach the concaving tool of the mouth. Therefore, when the infant (h) holds the pacifier 10 in his/her mouth, he/she is not stimulated to suckle.

Accordingly, the pacifier trains an infant to outgrow his/her suckling and directs him/her to the next stage of ingestion.

Thus, as shown in FIG. 7, the nipple 11 has a constricted part 14 near the base portion 13 rather than the tip portion 15. The constricted part is formed into a flatshape so that the pacifier trains an infant to close his/her mouth. Also, the constricted part 14 is held between the upper and the lower alveolars or baby teeth of the infant, so that it serves as a hook means for hooking the pacifier 10 at his/her mouth.

As described above, the constricted part 14 is formed to be flat to extend horizontally so as to be naturally held between the upper and the lower alveolars 33,34. Also, the constricted part 14 has a thickness, which corresponds to the symbol (C) in FIG. 7, of 3 to 7 mm, and, in particular, of 4 mm, approximately, as described before. If the thickness (a) is more than 7 mm, the difference between the forms of the constricted part and the tip portion is too little to be stably held between the upper and the lower alveolars. On the other hand, if the constricted part has the thickness (a) less than 3 mm, it is difficult to be removed from a mold in production. Also, in this case, the constricted part is too thin to be held between the upper and the lower alveolars 33,34.

Furthermore, when the constricted part 14 has a width (a) larger than 7 mm, it makes the upper and the lower alveolars 33,34 close insufficiently, which results in preventing the infant from being trained to close his/her lips.

Therefore, the present pacifier 10 prevents an infant from stimulating to suckle, and trains him/her to hold the constricted part 14 between the lower and the upper alveolars 33,34 so as to bite or close his/her mouth. Accordingly, the infant may be trained to close his/her mouth, which is necessary to progress from suckling and to start eating baby or general foods.

Also, an infant at these ages starts to eat baby food and to try to speak, so that the shape of the mouth changes, which results in increasing the number of mouth breaths. At that time, since the infant can not breathe through his/her mouth when closed for eating, he/she is required to be trained to breathe through his/her nose during eating. According to the present invention, when the pacifier 10 is held by an infant in his/her mouth such that the constricted part 14 is positioned between the upper and the lower alveolars 33,34, the infant closes his/her lips 31,32 and is encouraged not to breathe by the mouth. Therefore, if the pacifier 10 is usually held by the mouth, the infant is trained to breathe through his/her nose.

On the other hand, the lower curved surface 18 of the lower surface of the tip portion 15 contacts an adjacency of the central portion of the upper surface of the tongue 35 of an infant (h).

As described before, the lower curved surface 18 is formed to have a convex shape at the central portion thereof, so as to press the center of the tongue 35 of an infant (h).

Figure 8:
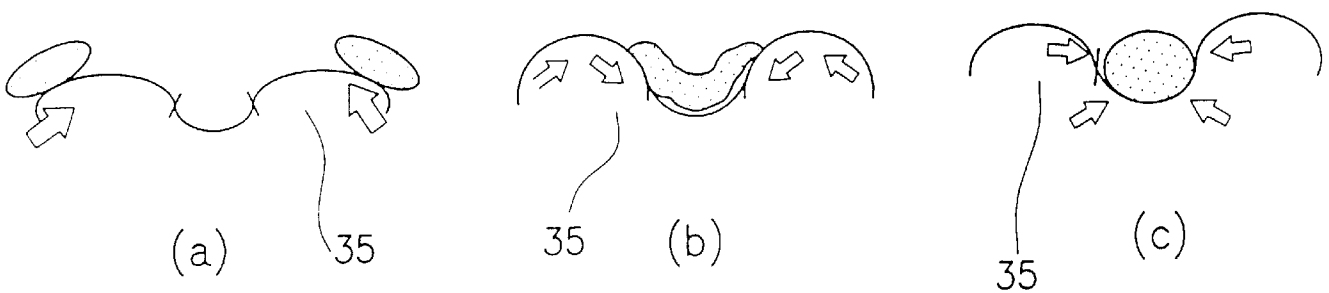
FIG. 8 shows an illustrative view for explaining the movement of a tongue while ingesting.
Figure 9:
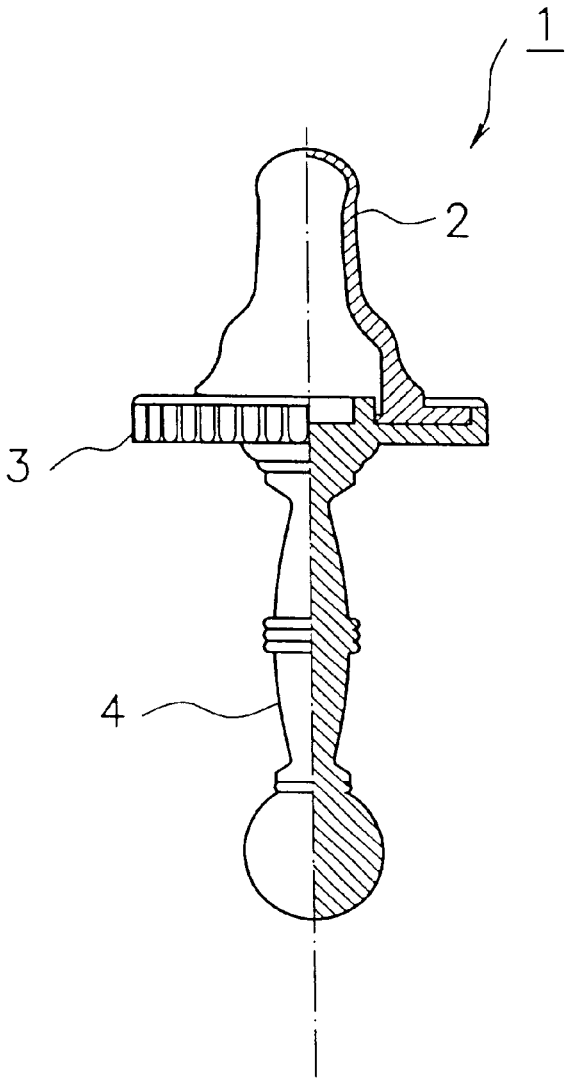
FIG. 9 shows a partially cross-sectional view of a pacifier according to prior art.

FIG. 8 shows an illustrative view for explaining the movement of the tongue 35 for eating. As shown in FIG. 8(*a*), solid food is chewed into a mass of food, which is directed to the shown arrow and to thereby be led into the center of the tongue 35 by its movement. At that moment, the tongue 35 moves such that the center thereof is transformed into a concave shape. In FIG. 8(*b*), the tongue 35 continues to move such that the mass of food is gathered into the center thereof, as shown by the arrow. Then, in FIG. 8(*c*), the mass of food is gathered in the concave portion of the tongue 35, and finally is swallowed.

As described above, it is important for ingestion to move the tongue to make a concave shape at the center thereof. According to the present invention, the lower curved surface 18 of the lower surface of the tip portion 15 contacts an adjacency of the center of the upper surface of the tongue 35 of an infant (h), so as to train him/her to make a concave shape there, which is necessary for ingestion.

In particular, the lower curved surface 18 of the lower surface of the tip portion 15 is designed to be easily transformed, as described before, so that the tongue 35 is trained to move appropriately for the above mentioned ingestion. Therefore, the pacifier may direct the tongue 35 to move appropriately for training.

Further, in the situation shown in FIG. 7 the shield plate 12 functions significantly in its particular designed shape. As shown in FIG. 6, each of the closely contacting portions 22,22 is provided at least on each side of the surface portion 21 of the shield plate 12, to be formed into a concave, so as to correspond to the curved surface at an adjacency of each of the cheeks of the user's face. Therefore, when an infant (h) sucks the nipple 11, each of the closely contacting portions 22,22 in the shield plate 12 contacts closely both of the cheeks respectively.

Furthermore, the upper area 27 in the surface portion 21 of the shield plate 12 is designed to have a concave curved in the same direction as each of the closely contacting portions 22,22 for facing the user's face, but to have a curved surface with a radius of curvature less than that of each of the closely contacting portions 22,22, as described before. Consequently, the upper area is fitted appropriately to the upper lip curve of an infant, as shown in FIG. 8.

Also, the lower area 26 in the surface portion 21, as described before, is designed to be curved in the opposite direction of each of the closely contacting portions 22,22. As shown in FIG. 7, since an infant has a lower jaw slightly projected in front, the lower area 26 in the surface portion 21 appropriately and closely contacts the adjacency of the lower jaw of an infant.

Accordingly, the surface portion 21 of the shield plate 12 has closely contacting portions 22,22, an upper area 27 and a lower area 26 respectively, which may contact closely and correspond to each of the areas of the face of an infant, so that the nipple 11 designed to have a predetermined size may be appropriately positioned in his/her mouth.

Also, even if the shield plate 12 contacts strongly the face of an infant (h), the shield plate is provided with a dull area 25 specially formed at both sides thereof so as not to press strongly and to make a track on his/her face.

According to the present invention, the embodiment of the pacifier 10 may train an infant of eight months of age to three years of age to gradually outgrow suckling and to preferably lead the next stage of ingestion, which is different from prior art. Therefore, the embodiment of the pacifier preferably stimulates in such a way suitable for his/her growth to interest him/her and trains to lead him/her into the next stage of ingestion. Also, the pacifier make an oral stimulation suitable for the infant at this age so as to interest him/her.

The present invention is not limited to the above mentioned embodiment.

Each of the structures as mentioned above may be abbreviated or combined each other into a modification as far as the beneficial effects according to the present invention are obtained. Furthermore, any structures not described above may be incorporated into the present invention.

Again, the present invention may preferably make a stimulation to an infant of eight months old or order in a way suitable for his/her growth, and interest him/her appropriately. Also, the present invention may properly direct him/her to the next stage of ingestion.

INDUSTRIAL APPLICABILITY

As described before the present invention may be applied to a pacifier which is used by an infant of eight months of age or older.

What is claimed is:

1. A pacifier including a nipple and an extending shield plate attached on a base portion of the nipple, the nipple comprising:

a tip portion having a width and a thickness, the width being larger than the thickness, so as to be formed into a flat shape; and an upper curved surface formed on an upper surface of the tip portion, the upper curved surface being designed to have a convex shape at a central portion thereof;

wherein the width of the tip portion of the nipple is between 20 mm and 30 mm;

and wherein the ratio of the width of the tip portion to the length of the nipple from the shield plate is between 0.75 and 2.0.

2. A pacifier according to claim 1, wherein a lower curved surface is formed on a lower surface of the tip portion of the nipple, the lower curved surface being designed to have a convex shape at a central portion thereof.

3. A pacifier according to claim 2, wherein the lower curved surface is designed to be more flexible than the upper curved surface.

4. A pacifier according to claim 1, wherein the nipple is formed to have a vertical length shorter than a horizontal length near the base portion thereof so that the nipple is formed to have a constricted part whose cross section is flat.

5. A pacifier according to claim 4, wherein the constricted part occupies an area including a length, the length being designed to be longer on the lower side of the nipple than on the upper side thereof.

6. A pacifier according to claim 1, wherein an area where the base portion of the nipple is connected to the shield plate is made of a member softer than that of the shield plate.

7. A pacifier according to claim 4, wherein the width of the constricted part is designed to be smaller than that of the tip portion.

8. A pacifier according to claim 1, wherein the shield plate comprises, a plate member surrounding the base portion;

a face surface in the plate member for being a user; and a closely contacting portion formed to be concave at least at the right and the left sides of the face surface;

wherein the face surface is designed to be curved outwardly at least at periphery of the right and the left sides thereof so as to form a dull portion;

wherein an area where the face surface of the shield plate contacts a chin of the user is curved in the opposite direction of the closely contacting portion; and wherein the face surface of the shield plate has an upper area including an upper periphery without forming a dull portion so that the upper periphery comprises a curved surface curved in the same direction to the face surface.

* * * * *

UNITED STATES PATENT AND TRADEMARK OFFICE

CERTIFICATE OF CORRECTION

PATENT NO. : 6,767,357 B2
DATED : July 27, 2004
INVENTOR(S) : Hiroyuki Uehara et al.

It is certified that error appears in the above-identified patent and that said Letters Patent is hereby corrected as shown below:

Title page,
Item [54], Title, should read -- A PACIFIER AND SHIELD PLATE THEREFORE --.

Column 14,
Line 14, please change "for being a user" into -- for facing a user --.

Signed and Sealed this

First Day of February, 2005

JON W. DUDAS
*Director of the United States Patent and Trademark Office*